US007681420B2

(12) United States Patent
Jeong et al.

(10) Patent No.: US 7,681,420 B2
(45) Date of Patent: Mar. 23, 2010

(54) WASHING MACHINE AND METHOD OF CONTROLLING THE SAME

(75) Inventors: In Chul Jeong, Seoul (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 1199 days.

(21) Appl. No.: 11/181,622

(22) Filed: Jul. 13, 2005

(65) Prior Publication Data

US 2006/0075577 A1 Apr. 13, 2006

(30) Foreign Application Priority Data

Oct. 8, 2004 (KR) ..... 10-2004-0080383

(51) Int. Cl.
*D06F 35/00* (2006.01)

(52) U.S. Cl. ..... 68/20; 68/12.01; 68/12.15

(58) Field of Classification Search ..... 68/12.01, 68/12.15, 20

See application file for complete search history.

(56) References Cited

U.S. PATENT DOCUMENTS 4,700,492 A 10/1987 Werner et al.
4,921,511 A * 5/1990 Dreischmeier ..... 55/294
5,584,913 A * 12/1996 Williams ..... 95/280
2004/0221474 A1* 11/2004 Slutsky et al. ..... 34/319

FOREIGN PATENT DOCUMENTS

| | | | |
|---|---|---|---|
| DE | EP 1098028 | * | 10/2000 |
| EP | 0 816 549 A2 | | 1/1998 |
| EP | 0816549 | | 1/1998 |
| EP | 1 098 028 A2 | | 5/2001 |

* cited by examiner

*Primary Examiner*—Michael Barr
*Assistant Examiner*—Jason Heckert
(74) *Attorney, Agent, or Firm*—Lee, Hong, Degerman, Kang & Waimey

(57) ABSTRACT

A washing machine and a method of controlling the same are provided. The washing machine includes an exhaust port, a filter, and a nozzle. Humid air in a tub is exhausted through the exhaust port to the outside. The filter filters is provided to the exhaust port to filter lint. The nozzle sprays air to the filter. The lint filtered by the filter is automatically removed, so that use convenience safety is enhanced and dry efficiency of the washing machine is improved.

10 Claims, 9 Drawing Sheets

WASHING MACHINE AND METHOD OF CONTROLLING THE SAME

BACKGROUND OF THE INVENTION

1. Field of the Invention

The present invention relates to a washing machine, and particularly, to a washing machine and a method of controlling the same capable of solving a lint problem occurring at the laundry. More particularly, the present invention relates to a drum washing machine and a method of controlling the same capable of improving use convenience by allowing lint to be condensed and the condensed lint to be automatically discharged.

2. Description of the Related Art

A general drum washing machine includes a main body having a hexahedral shape, a drum installed in the main body and having a plurality of holes, a tub enclosing the drum and in which washing water is taken, a drive motor for rotating the drum; and a detergent box for receiving detergent, a water pipe connected with the detergent box, for supplying the washing water or the washing water mixed with the detergent of the detergent box, a drain pipe for draining the washing water used in a washing cycle to the outside, and a pump and a drain hose connected with the end of the drain pipe, for forcibly draining the washing water.

The drum washing machine puts the laundry, supplies the washing water into the drum and performs the washing cycle using friction with the washing water produced while the laundry falls in a gravity direction when the drum rotates. Recently, the drum washing machine has an additional function and can perform a spinning and dry cycles for the laundry after the washing cycle besides the washing cycle.

The washing machine that performs the dry cycle has a ventilation duct installed on one side of the tub to allow hot wind to be blown to the laundry in the drum after the spinning cycle for the laundry and allow humidity of the laundry to be evaporated by the hot wind. During the dry cycle, air containing humidity is exhausted to the outside of the washing machine. In the meantime, since an exhaust port is extended to the outside of the main body, it also serves as a respiration hole when an infant or a pet is confined in the washing machine.

In the washing machine having a dry function, lint (fine fluff generated from the laundry) is produced from the laundry when the dry cycle is performed. The lint is circulated in the drum within the washing machine by hot wind and discharged through the exhaust port to the outside of the washing machine. However, since the lint has weight and volume of its own though it is fine, the lint is accumulated in a position adjacent to the exhaust port, particularly in a bellows for connecting the exhaust port with the tub.

When the lint is constantly accumulated, it blocks the exhaust port after all, which hinders the hot wind from circulating during the dry cycle, so that not only dry efficiency is deteriorated but also the dry condensed lint has danger of catching fire due to the hot wind thereof. Also, since the exhaust port cannot properly serve as a respiration hole due to the lint when an infant or a pet is confined in the washing machine, danger of the washing machine increases.

Considering the above problems, a filter for filtering the lint has been suggested to prevent the lint from being accumulated in the exhaust port. The filter has a predetermined shape and is inserted into the exhaust port, so that when the lint is condensed more than a predetermined amount, a user may easily replaces the filter.

However, when the filter and the adjacent portion of the filter are not strongly bonded in such a structure, the lint leaks through a gap between them, leaking out together with the hot wind. Further, the leaked hot wind distorts or wrenches each part of the washing machine made of synthetic resin and thus transforms the appearance. Such problems have an influence on each part constituting the washing machine and deteriorate reliability of the product.

Also, when a user does not replace the filter periodically and an excessive amount of lint is accumulated on the filter, dry efficiency deterioration, danger of catching fire, and a safety problem still occur.

SUMMARY OF THE INVENTION

Accordingly, the present invention is directed to a washing machine and a method of controlling the same that substantially obviate one or more problems due to limitations and disadvantages of the related art.

An object of the present invention is to provide a washing machine and a method of controlling the same capable of preventing lint from being excessively accumulated at a filter.

Another object of the present invention is to provide a washing machine and a method of controlling the same capable of allowing lint not to be accumulated in a bellows having unevenness therein to prevent the lint from catching fire due to hot wind, and allowing a respiration hole function to be reliably performed in preparation for the case that an infant or a pet is confined in the washing machine.

A further another object of the present invention is to provide a washing machine and a method of controlling the same capable of using a filter semipermanently by having lint condensed at the filter automatically removed even when a user does not clean the filter separately.

A still further another object of the present invention to provide a washing machine and a method of controlling the same capable of enhancing dry efficiency and use convenience of the washing machine by preventing dry efficiency from being deteriorated.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine including: a main body; a tub for storing washing water in an inside of the main body; a drum received in the tub and rotating; a fan for supplying dry air to the tub; a ventilation duct for connecting the fan with the tub; an exhaust unit for providing a pipe through which the dry air containing humidity of an inside of the tub is exhausted from the tub; a filter provided to the exhaust unit, for filtering lint; and a nozzle for spraying air to the filter to remove collected lint from the filter.

In another aspect of the present invention, there is provided a method of controlling a washing machine, including: a dry-cycle drying a laundry by blowing air after the laundry is washed; and a lint removal cycle forcibly spraying fluid to a filter to remove lint collected at the filter.

In a further another aspect of the present invention, there is provided a washing machine including: a suction unit through which dry air flow to an inside of a tub; an exhaust unit through which humid air in the inside of the tub is exhausted; a filter provided to the exhaust unit, for filtering a lint; and a lint removal unit for spraying air to the filter.

According to the present invention, safety of a washing machine is improved and dry efficiency of the washing machine is improved.

Also, according to the present invention, the lint condensed at the filter is automatically removed, so that use convenience and stability of the washing machine are improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
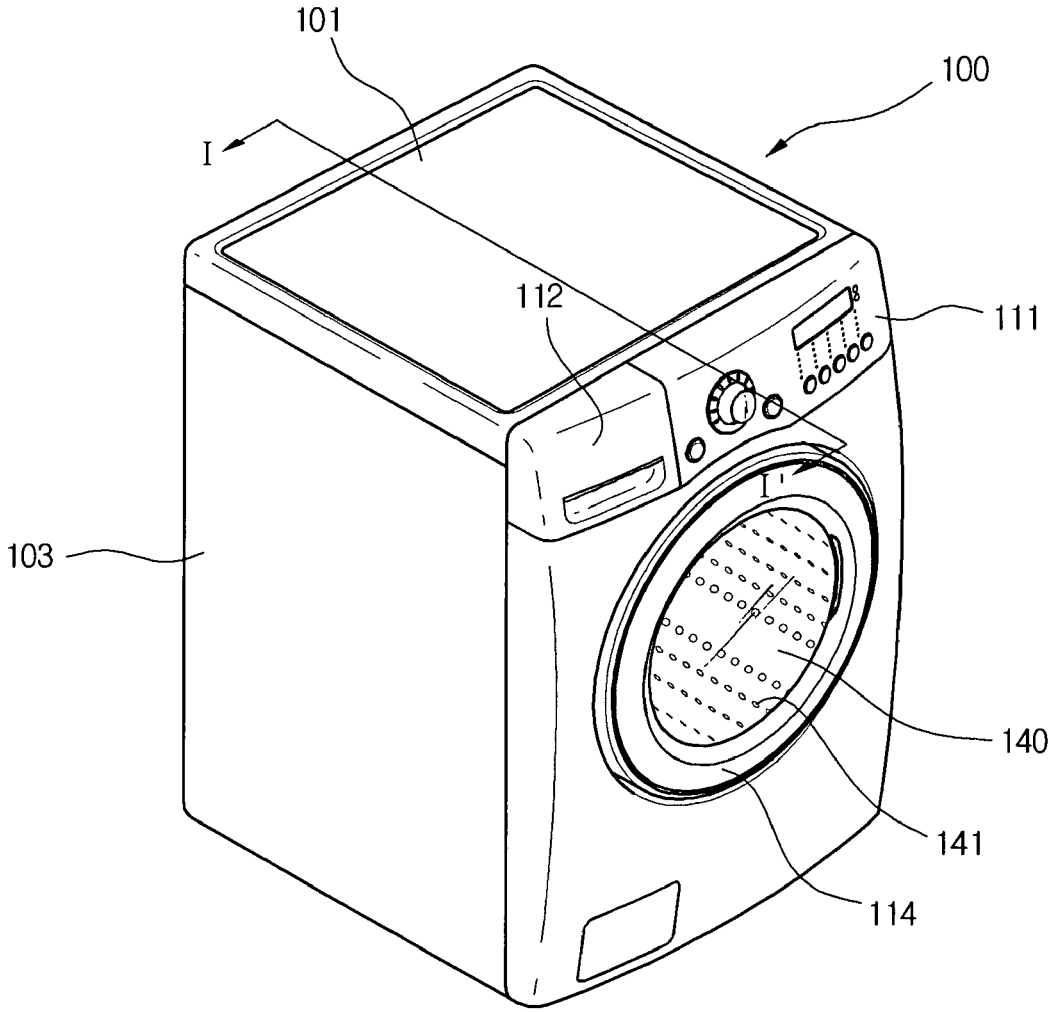
FIG. 1 is a perspective view of a drum washing machine according to the present invention.
Figure 2:
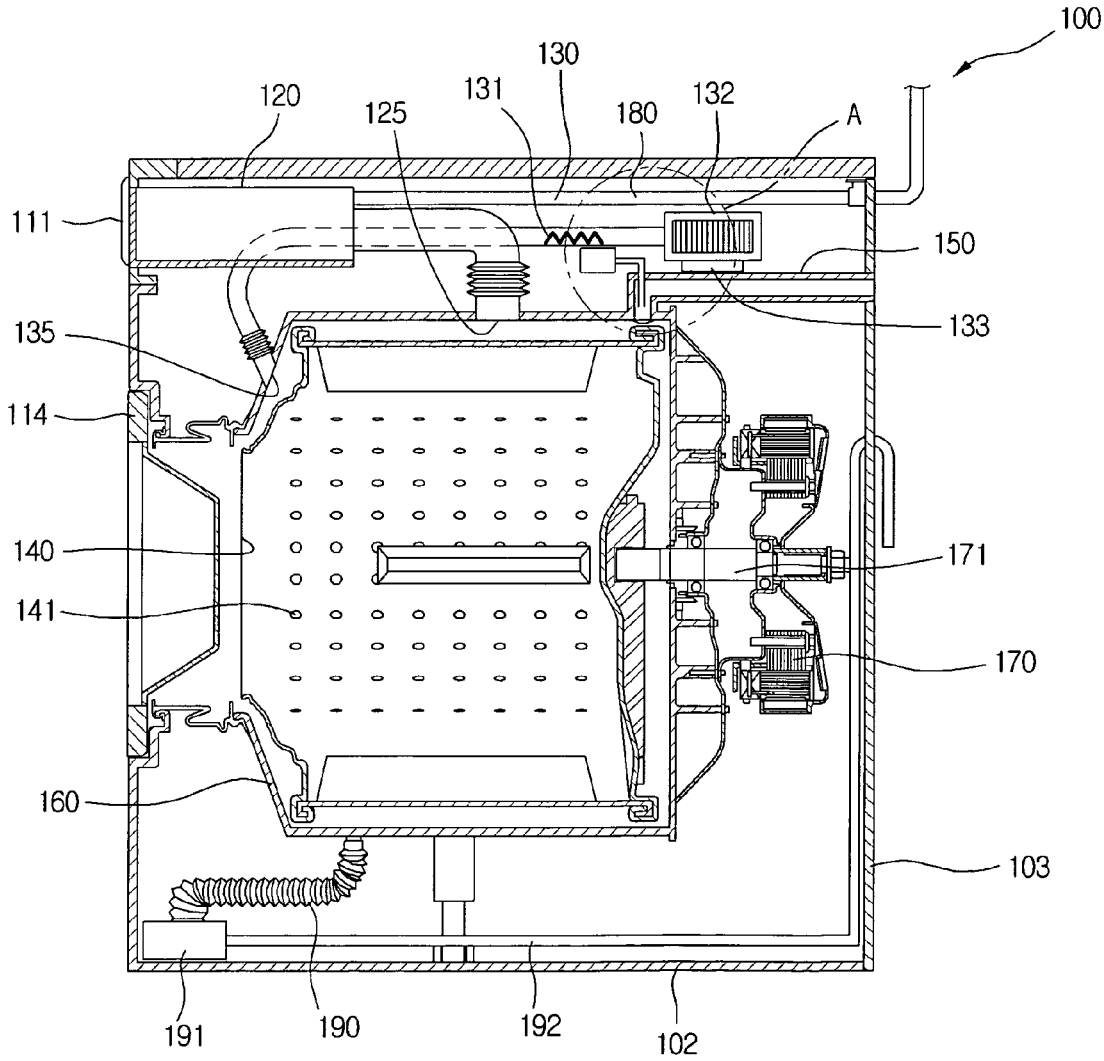
FIG. 2 is a sectional view taken along a line I-I' of FIG. 1.

FIG. 1 is a perspective view of a drum washing machine according to the present invention and FIG. 2 is a sectional view taken along a line I-I' of FIG. 1.

Referring to FIGS. 1 and 2, a washing machine main body 100 having a drum and a tub installed therein and a door 114 formed on a front side of the main body 100 constitute an appearance of the washing machine of the present invention. A detergent insertion member 120 and a controller 111 are installed on an upper portion of the main body 100.

The main body 100 has a cabinet 103 fixed between an upper plate 101 and a lower plate 102 and thus has a predetermined vacant space formed therein. A plurality of parts such as a drive motor 170 and a drum 140 required for operation of the washing machine are installed in an inside of the cabinet 103. The drive motor 170 rotates a drive shaft 171 using a current applied from the outside to allow the washing machine to operate.

In detail, the drive shaft 171 passes through a tub 160 and is fixed on a backside of the drum 140 to rotate the drum 140. The drum 140 is open to the side of the door 114 so that the laundry may be inserted therein. The tub 160 is provided to the outer surface of the drum 140 and maintains airtightness against the outside lest washing water taken in the inside of the tub 160 should leak out.

Also, a ventilation duct 130 is installed in an interval between the tub 160 and the upper plate 101 to communicate with one side of the tub 160. The ventilation duct 130 is intended for supplying hot air to the inside of the tub 160 when the laundry is dried. Parts related to the ventilation duct 130 are described in detail. The ventilation duct 130 has a fan 132 for forcibly blowing air and a motor 133 for rotating the fan 132 provided to one side thereof. A heater 131 for generating heat using electricity is installed in the inside of the ventilation duct 130 to allow air blown to the tub 160 to change into hot wind while passing through the heater 131. One end of the ventilation duct 130 communicates with a ventilation port 135 to allow the hot wind to be supplied to the tub 160.

The detergent insertion member 120 is positioned at the lower portion of the upper plate 101 on the front side of the washing machine to allow inner detergent mixed with water that has flowed from the outside to be taken to the inside of the tub 160. Also, with the detergent insertion member 120 connected with a water piper 180 to which hot/cool water is supplied, the hot/cool water is supplied from the water pipe 180 and the supplied water is mixed with the detergent and the fiber softener contained in the detergent insertion member 120 and supplied to the tub 160. The tub has a water port 125 to allow the water flowing from the detergent insertion member 120 to be taken into the tub 160.

Also, the tub 160 has an exhaust port 155 and is connected with an exhaust duct 150. A filter 300 is installed in the exhaust port 155 which is a boundary between the tub 160 and the exhaust duct 150. The filter 300 is formed of dense meshes. The exhaust duct 150 provides a passage through which air containing lint is exhausted to the outside.

Also, the exhaust duct 150 is connected with the tub 160 by a bellows 151. The bellows 151 is installed to suppress vibrations occurring when a drum 140 installed in the inside of the tub 160 rotates. That is, the bellows is installed so that the vibrations occurring when the drum 140 rotates may not be transferred to the outside but absorbed. Further, such a bellows is also installed to the ventilation port 135 and the water port 125 besides the exhaust duct 150 so that vibrations may not be transferred to the outside. Also, the tub 160 can be supported against the cabinet 103 by an elastic spring and a damper so that the tub 160 may be properly supported within the washing machine.

Further, a plurality of holes 141 are formed in the drum 140 to allow the water taken into the tub 160 to be also swiftly supplied to the inside of the drum 140. The holes 141 also allows the water to be swiftly drained from the drum 140 when the spinning cycle is performed after the washing cycle is finished.

Figure 3:
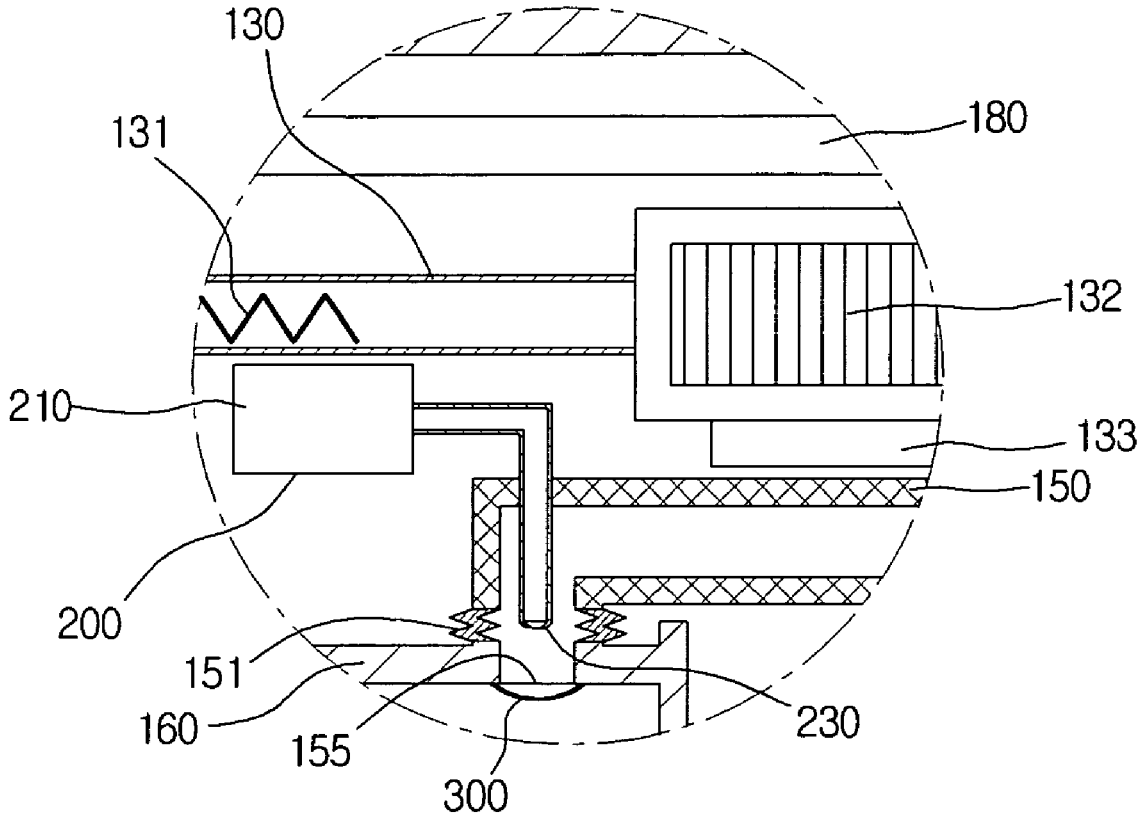
FIG. 3 is an enlarged view of a portion "A" of FIG. 2.

Also, a lint removal unit 200 is installed in the exhaust duct 150 communicating with the tub 160 to remove lint condensed at the filter 300. Construction of the lint removal unit 200 will be described in detail with reference to FIG. 3, which is an enlarged view of a portion "A" illustrated in FIG. 2.

The lint removal unit 200 includes: an air pump 210 for compressing air; and a nozzle 230 connected with one end of the air pump 210 and extended to the side of the filter 300. In detail, the nozzle 230 is extended up to the backside of the filter 300.

In operation, when lint is collected on the front side of the filter 300, air compressed by the air pump 210 is sprayed toward the backside of the filter. Then, the sprayed air allows the lint condensed at the front side of the filter 300 to fall downward, so that the lint may be accommodated in the inside of the tub 160 and exhausted to the outside of the washing machine when the water is drained.

A method of controlling the washing machine having the above construction will be described below in detail.

First, in the washing cycle, after the laundry is received in the drum 140, the washing water is supplied to the tub 160. At this point, the inside of the drum is filled with the washing water supplied through the holes 141 formed in the drum 140. When the tub 160 is filled with water more than a predetermined level, the drive motor 170 rotates under control of the controller 111 and accordingly the drum 140 rotates.

As described above, when the drum 140 rotates, the laundry falls down into the washing water and the laundry collides with and rubs against the washing water. The washing cycle for the laundry is performed using the above-mentioned friction process.

After the washing cycle is performed, the spinning cycle for draining water is performed.

The spinning cycle includes a cycle for completely removing the water from the laundry after the washing water is drained naturally. At this point, the drum 140 rotates in high speed first so that the washing water is forcibly drained through the holes 141 by centrifugal force of the rotating drum 140 and collected to the tub 160. The collected water is pumped by a drain duct 190 and a drain pump 191 installed in the lower portion of the tub 160 and drained along a drain hose 192 to the outside.

After the spinning cycle, a rinsing cycle can be further performed. After the rinsing cycle, another rinsing cycle can be further performed to completely remove the detergent from the laundry. After the washing water is removed by a final spinning cycle, a dry cycle for drying remaining washing water can be performed by a ventilation cycle for forcibly blowing hot wind.

During the ventilation cycle, air blown by the fan 132 is heated and dried by a heater 131 while flowing through the ventilation duct 130. After that, the hot wind flows into the rotating drum 140 to dry the laundry therein and is exhausted through the exhaust duct 150 formed on the tub 160 to the outside.

While the hot wind is exhausted, the lint conveyed on the hot wind is filtered by the filter 300 and the amount of the lint collected by the filter 300 increases as the number of the ventilation cycles increases. Therefore, a lint-removal cycle for removing the lint is performed afterward.

During the lint-removal cycle, air compressed by an air pump 210 is strongly sprayed on the backside of the filter 300 through the nozzle 230. When the compressed air is sprayed on the backside of the filter 300, the lint collected on the front side of the filter 300 falls downward, moves to the inside of the tub 160, and is discharged together with the washing water to the outside during the washing cycle next time.

The lint-removal cycle can be performed every single ventilation cycle, so that the excessive collection of the lint may be fundamentally prevented. Also, the lint-removal cycle may be performed after ventilation cycles are performed several times.

However, when the ventilation cycle for evaporating a small amount of water held by the laundry using the dry air is performed by the washing machine, the lint-removal cycle is further performed to prevent the problem occurring due to the collection of an excessive amount of lint.

Since the lint collected by the filter 300 can be automatically removed and discharged to the outside of the washing machine during the lint-removal cycle, which is one of characteristics of the present invention, a concern that the lint might be excessively collected at the filter is relieved. Also, a safety problem that might occur when the excessive amount of lint is accumulated is not generated and a user does not need to clean the filter 300 separately.

Second Embodiment

The second embodiment of the present invention is the same as the first embodiment except the manner of spraying air using the filter. Therefore, description will be made below mainly for the different point of the second embodiment and the description for the first embodiment will be quoted for the same parts.

Figure 4:
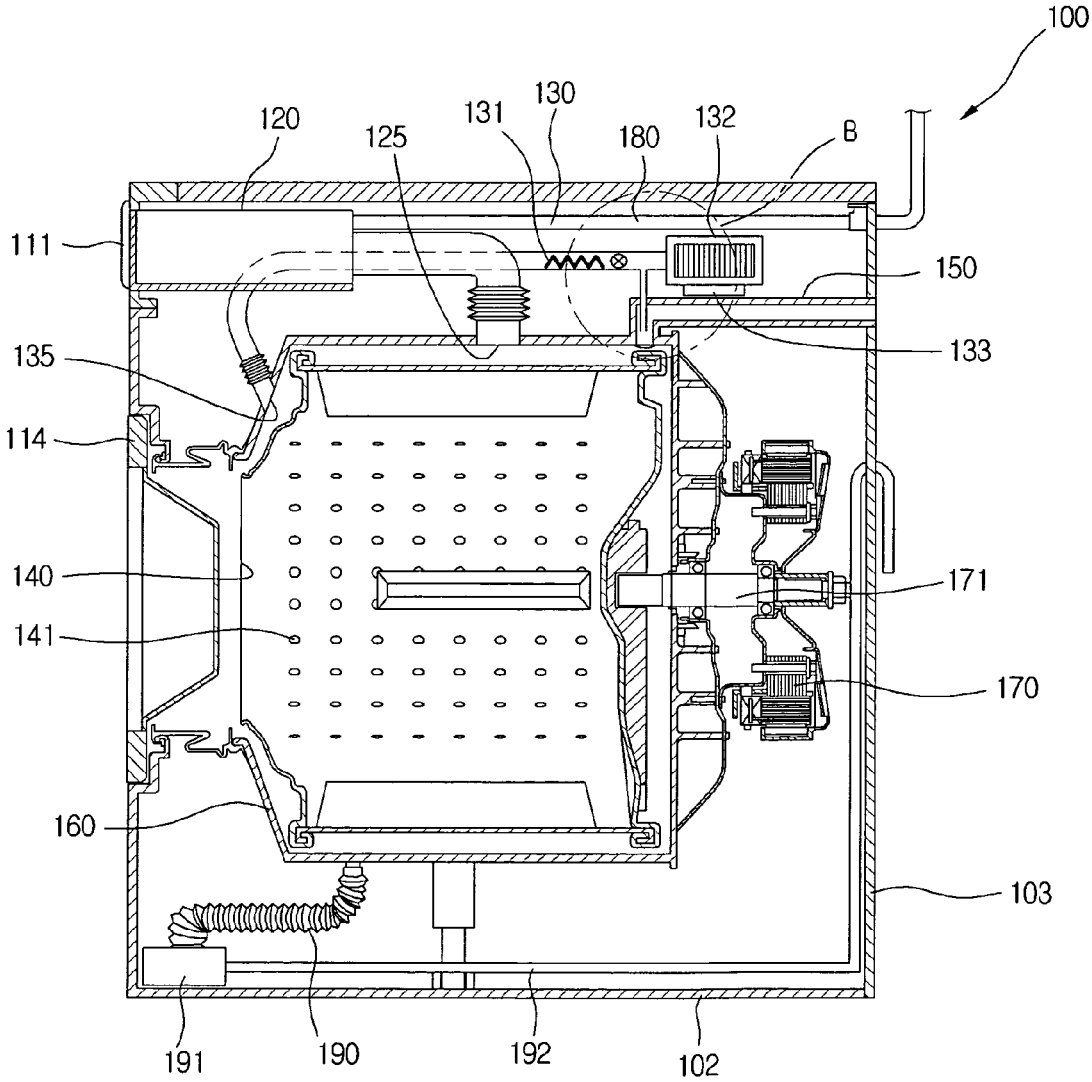
FIG. 4 is a sectional view of a washing machine according to the second embodiment of the present invention.
Figure 5:
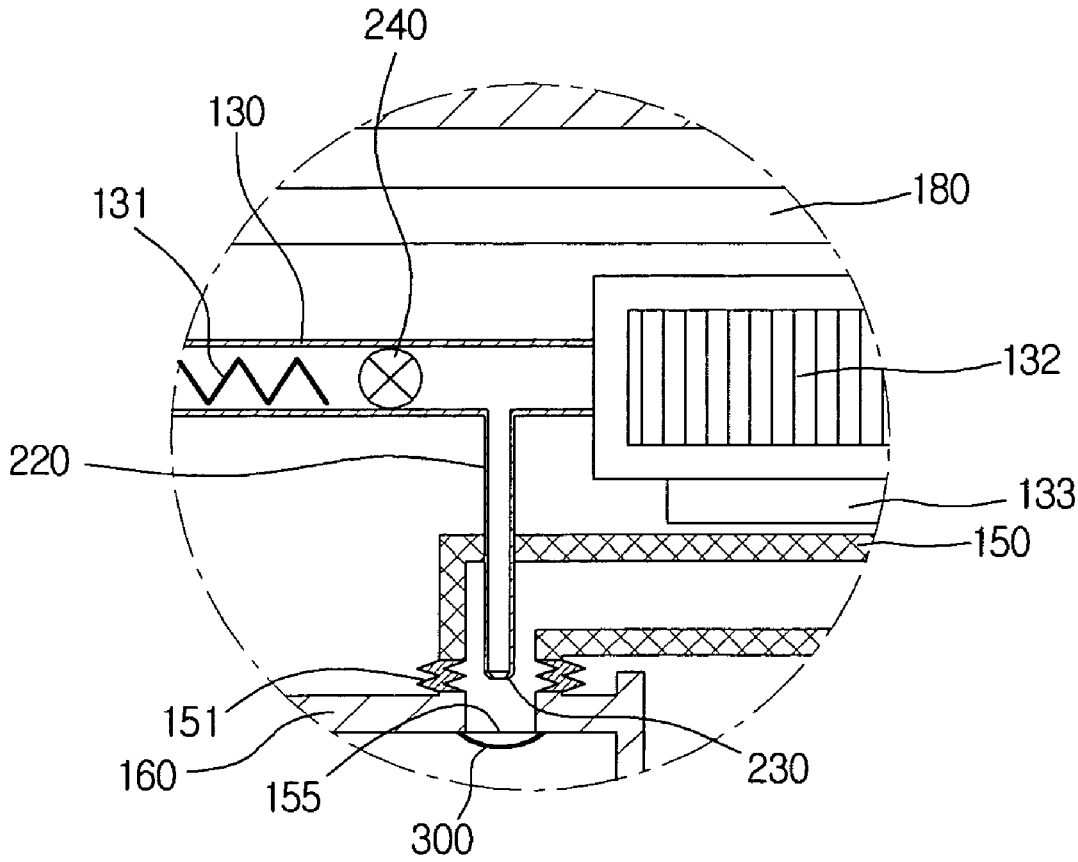
FIG. 5 is an enlarged view of a portion "B" of FIG. 4.

FIG. 4 is a sectional view of a washing machine according to the second embodiment of the present invention and FIG. 5 is an enlarged view of a portion "B" of FIG. 4.

Referring to FIGS. 4 and 5, the lint removal unit 200 has a nozzle 230 whose one end is connected with a ventilation duct 130 and the ventilation duct 130 has an open/close valve 240 for switching a flowing direction of air pressurized by the fan 132 therein. The open/close valve 240 is installed in a backside of a connection portion between the ventilation duct 130 and the nozzle 230, so that the air blown by the fan 132 may move toward the nozzle 230 when the open/close valve 240 is closed.

In the second embodiment, the description for the first embodiment will be quoted for a washing cycle, a spinning cycle, a rinsing cycle, and a ventilation cycle. Hereinafter, a lint-removal cycle will be described in detail.

To remove the lint collected at the filter 300, the open/close valve 240 installed in the ventilation duct 130 is closed so that supply of the dry air flowing into the tub 160 is blocked. At this point, the wind blown by the fan 132 is concentrated toward the nozzle 230 branching off from the ventilation duct 130. The nozzle 230 is disposed at the back portion of the filter 300. Accordingly, the collected lint is separated from the filter 300 by the air sprayed from above the filter 300 and falls down to the tub 160. The lint fallen to the tub 160 is discharged to the outside of the washing machine during a drain cycle of the washing water when the washing cycle is performed next time.

Here, the close/open valve 240 installed in the ventilation duct 130 may be installed in an inside of a pipe of the nozzle 230. With the above construction, when the open/close valve 240 installed in the ventilation duct 130 is opened, another open/close valve installed in the nozzle 230 is closed. On the contrary, when the open/close valve 240 of the ventilation duct 130 is closed, the open/close valve of the nozzle 230 is opened. With such a construction, since the air blown by the fan 132 does not leak, efficiency of the ventilation cycle and the lint-removal cycle can be improved even more. Of course, in the case where the open/close valve is installed in the nozzle 230, it is possible to control a passage for the air blown by the fan 132 by controlling the open/close state of the nozzle 230.

Also, even in the case where a 3-way valve is installed in the connection portion between the ventilation duct 130 and the nozzle 230, an effect of the second embodiment for controlling the passage of the air blown by the fan 132 can be accomplished.

Third Embodiment

The third embodiment is the same as the second embodiment except a spray part of a nozzle 230. In detail, it is possible to more effectively remove the lint by allowing sprayed air to be distributed to a wide area.

Figure 6:
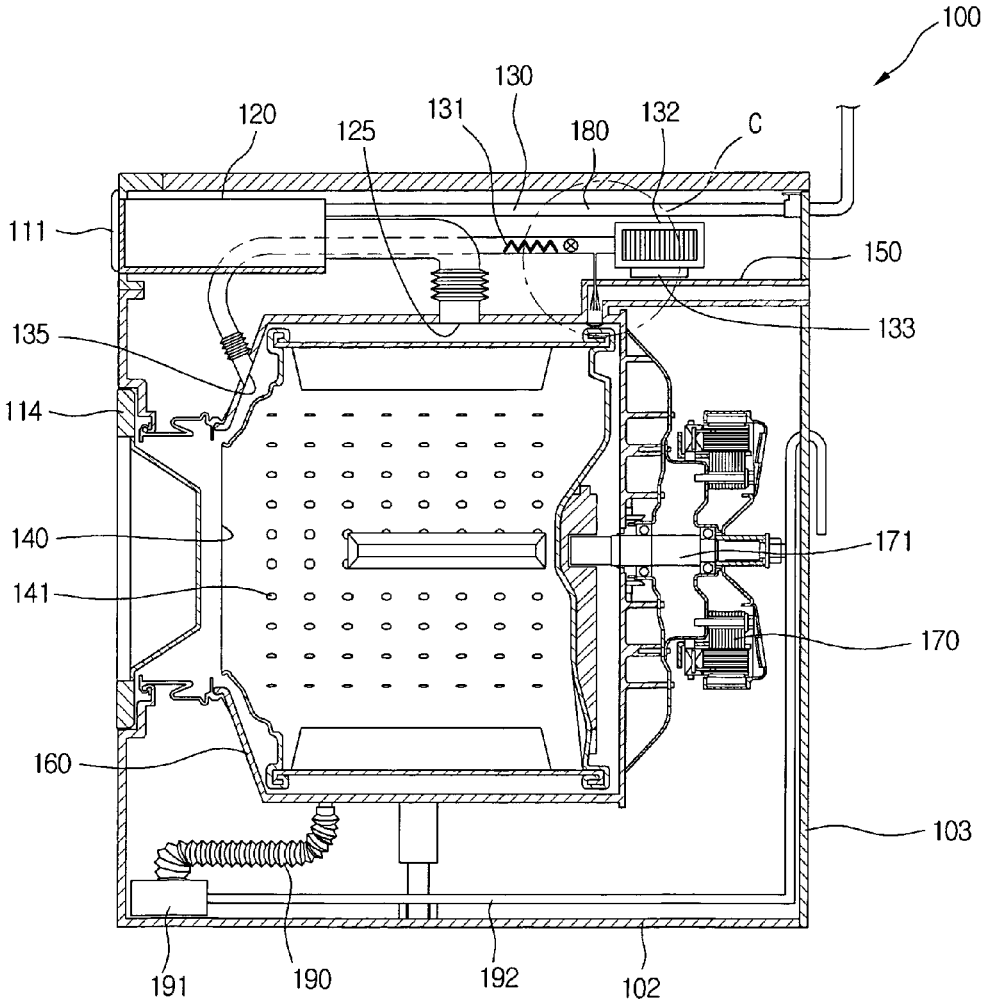
FIG. 6 is a sectional view of a washing machine according to the third embodiment of the present invention.
Figure 7:
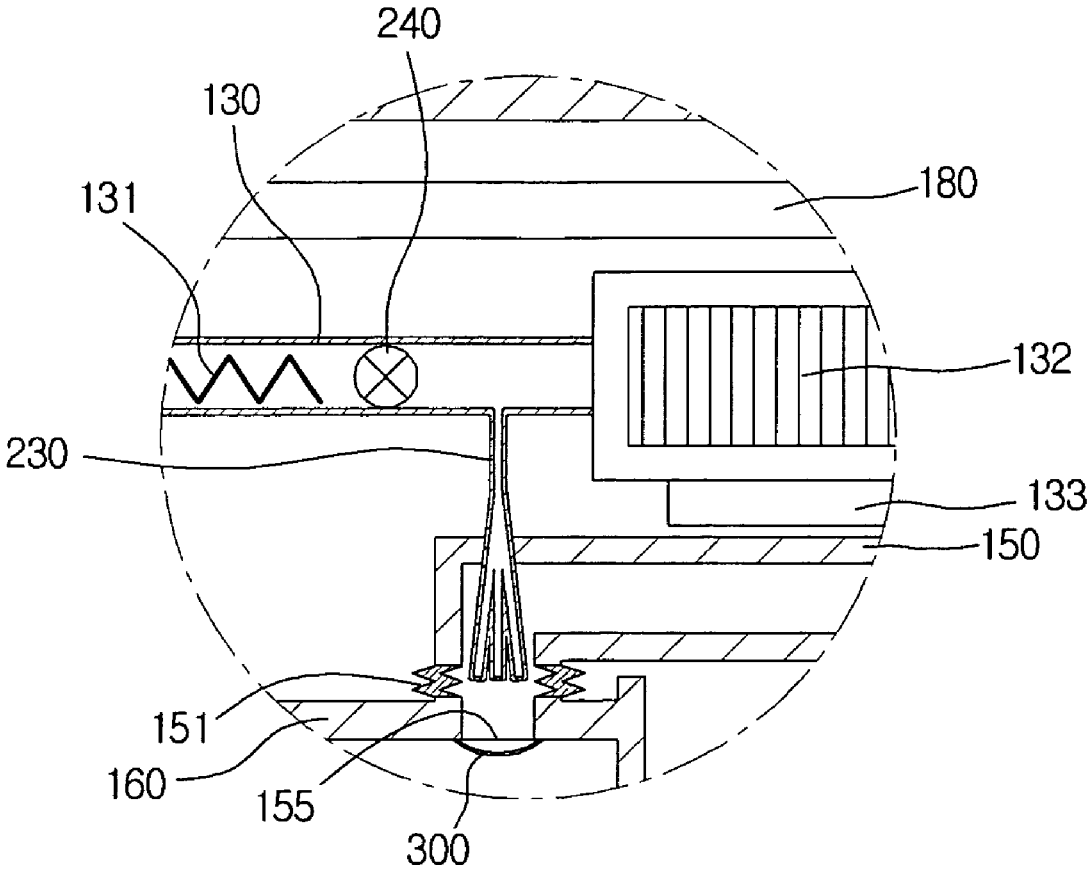
FIG. 7 is an enlarged view of a portion "C" of FIG. 6.

FIG. 6 is a sectional view of a washing machine according to the third embodiment of the present invention and FIG. 7 is an enlarged view of a portion "C" of FIG. 6.

Referring to FIGS. 6 and 7, the nozzle 230 has a discharge end including at least one branch toward the entire backside of the filter 300. As the nozzle 230 branches off as described above, the compressed air is sprayed over the entire area of the filter 300. Therefore, the lint collected over the entire area of the filter 300 can be effectively removed on the whole.

The idea may be directly applied to the first embodiment.

Fourth Embodiment

The fourth embodiment is the same as the second embodiment except the position on which a filter 300 and a nozzle 230 are disposed.

Figure 8:
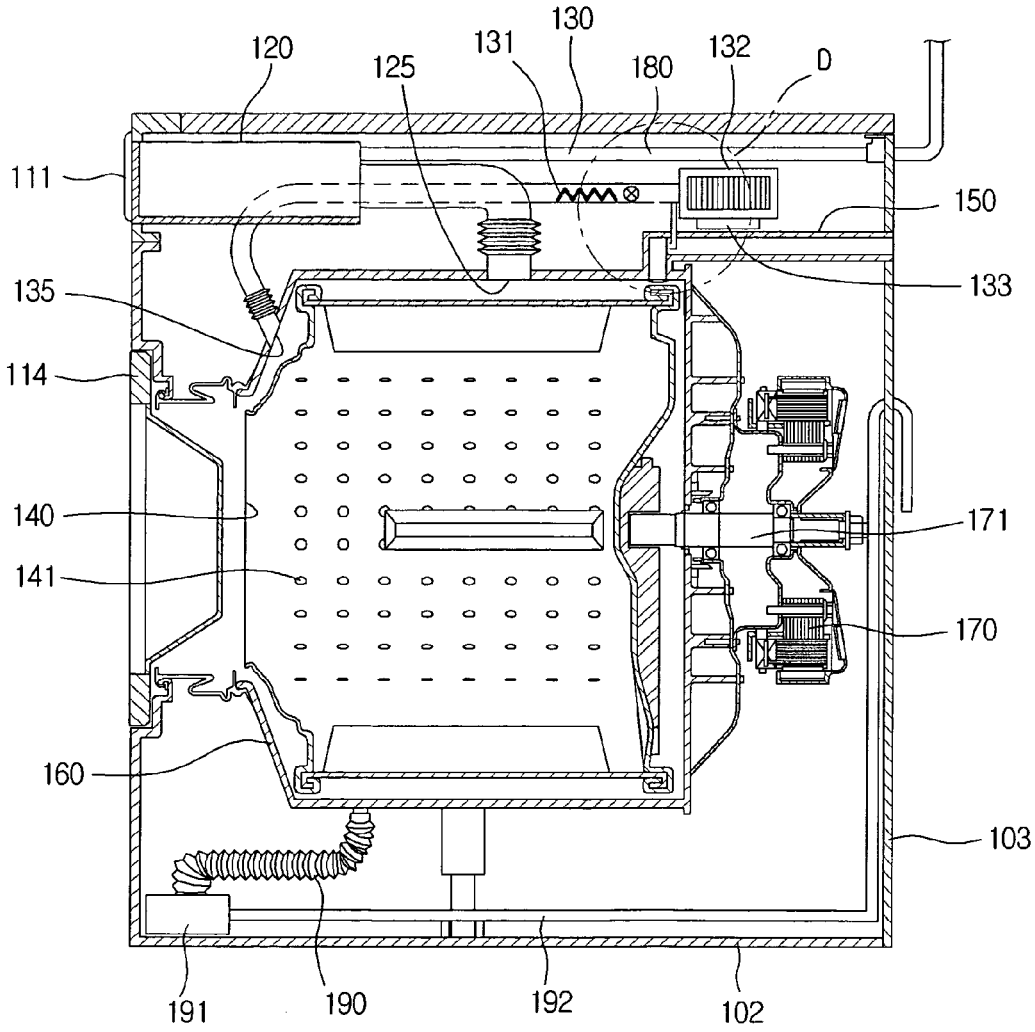
FIG. 8 is a sectional view of a washing machine according to the fourth embodiment of the present invention.
Figure 9:
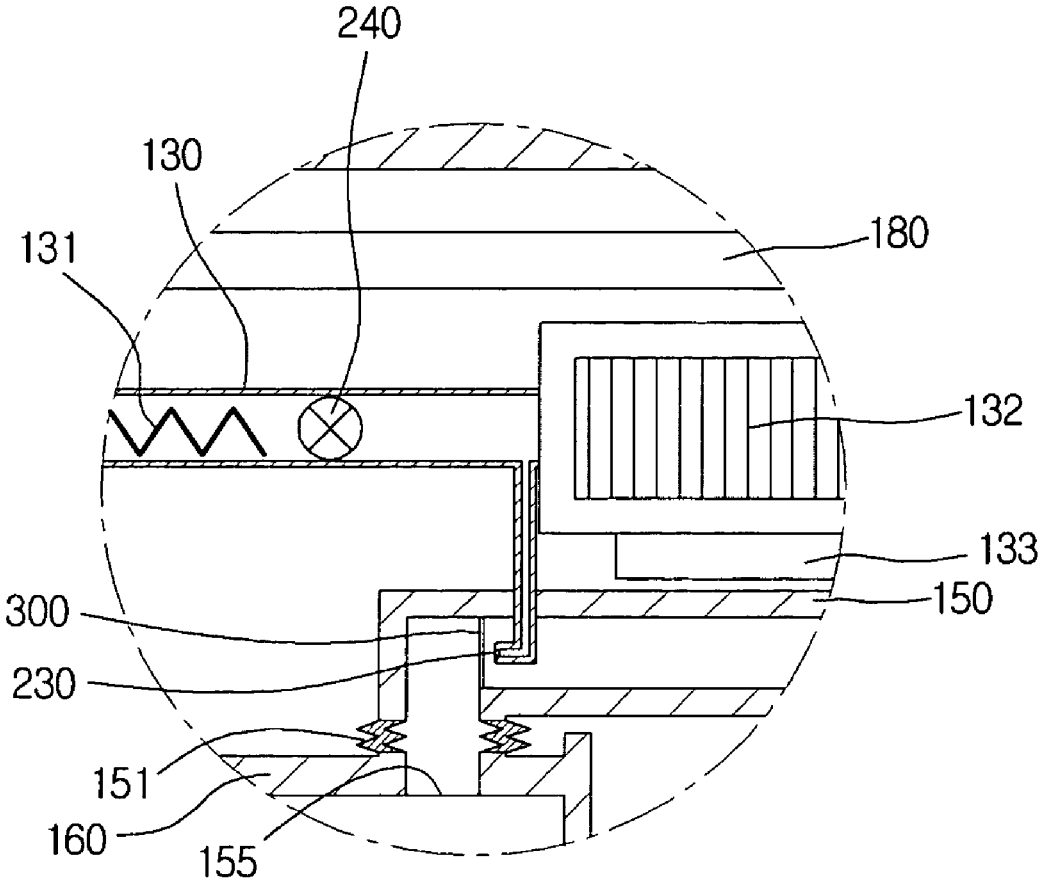
FIG. 9 is an enlarged view of a portion "D" of FIG. 8.

FIG. 8 is a sectional view of a washing machine according to the fourth embodiment of the present invention and FIG. 9 is an enlarged view of a portion "D" of FIG. 8.

Referring to FIGS. 8 and 9, the filter 300 is disposed on the end of a bent exhaust duct 150 and the nozzle 230 has one end disposed on the backside of the filter 300 to spray compressed air toward the backside of the filter 300.

Unlike the previous embodiment, the filter 300 is formed on the side of the discharge duct 150, not the tub 160. With such a construction, collision between the bellows 151, the tub 160, and the nozzle 230 can be prevented when the tub 160 vibrates, so that destruction of the nozzle 230 can be prevented. In detail, in the case where the filter is formed on the tub 160 and the nozzle 230 is formed on the discharge duct 150, the nozzle 230 collides with the bellows 151 and the tub 160 when the tub 160 vibrates by rotation of the drum 140. The collision occurs because the vibration of the tub 160 is not transferred in phase to the discharge duct 150 through the bellows 151. To solve such a problem, both the filter 300 and the nozzle 230 can be formed in the discharge duct 150, so that the problem that the nozzle 230 changes in its position or destroyed is fundamentally solved.

According to the present invention, since the lint is prevented from flowing into the discharge duct, it is possible to prevent the discharge duct from being blocked by the lint or catching fire due to the lint accumulated in the discharge duct and thus safety is improved.

Also, since a user does not need to remove the lint in person, use convenience is improved.

Also, since the lint is not accumulated excessively, the dry efficiency of the washing machine is improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine comprising:

a main body;

a tub for storing washing water in an inside of the main body;

a drum received in the tub and rotating a ventilation fan for supplying dry air to the tub;

a ventilation duct for connecting the ventilation fan with the tub;

an exhaust unit for providing a pipe through which the dry air containing humidity of an inside of the tub is exhausted from the tub;

a filter provided to the exhaust unit, for filtering lint; and a nozzle for spraying air to the filter to remove collected lint from the filter, wherein the nozzle comprises an inlet end connected with a portion of an air flow-path of the ventilation duct between the tub and the ventilation fan, and wherein the lint removed from the filter is accommodated in the inside of the tub and exhausted to an outside of the tub when water is drained from the tub.

2. The washing machine according to claim 1, wherein the filter is installed in the tub.

3. The washing machine according to claim 1, wherein the exhaust unit comprises: an exhaust duct connected with the tub and a bellows for connecting the exhaust duct with the tub, and the nozzle is installed in the exhaust duct.

4. The washing machine according to claim 1, wherein the nozzle faces a backside of the filter.

5. The washing machine according to claim 1, wherein the nozzle has a plurality of spraying ends.

6. The washing machine according to claim 1, further comprising an air pump for supplying air to the nozzle.

7. The washing machine according to claim 1, wherein the filter is provided to an inside of an exhaust port extended to an upper side of the tub.

8. The washing machine according to claim 1, wherein the ventilation duct has an open/close valve for controlling a flowing direction of air.

9. The washing machine according to claim 1, wherein the nozzle has an open/close valve for controlling a flowing direction of air.

10. The washing machine according to claim 1, wherein a 3-way valve is provided to a connection portion between the nozzle and the ventilation duct.

* * * * *